United States Patent [19]

Matsushima

[11] Patent Number: 4,501,944

[45] Date of Patent: Feb. 26, 1985

[54] TURNTABLE TYPE HIGH-FREQUENCY HEATING APPARATUS

[75] Inventor: Haruo Matsushima, Yamatokoriyama, Japan

[73] Assignee: Matsushita Electric Industrial Co., Ltd., Osaka, Japan

[21] Appl. No.: 451,781

[22] Filed: Dec. 21, 1982

[30] Foreign Application Priority Data

Dec. 25, 1981 [JP] Japan ..... 56-213466

[51] Int. Cl.[3] ..... H05B 6/74

[52] U.S. Cl. ..... 219/10.55 F; 219/10.55 R; 219/10.55 A

[58] Field of Search ..... 219/10.55 F, 10.55 E, 219/10.55 R, 10.55 A, 10.55 B

[56] References Cited

U.S. PATENT DOCUMENTS 3,373,259 3/1968 Smith ..... 219/10.55 F 3,436,506 4/1969 Smith ..... 219/10.55 F 4,276,462 6/1981 Risman ..... 219/10.55 F

*Primary Examiner*—Roy N. Envall, Jr.

*Assistant Examiner*—M. M. Lateef

*Attorney, Agent, or Firm*—Stevens, Davis, Miller & Mosher

[57] ABSTRACT

A high-frequency heating apparatus in which a waveguide having a rectangular terminating opening a×b is coupled with a heating chamber perpendicularly at the bottom wall thereby. The waveguide is excited in a $TE_{0,n}$ mode (n is any positive integer), and a turntable of dielectric material having a rotating center is located on a bisector between the crest (loop) and the valley (node) of this mode. A horizontal electric field is generated along the upper surface of the turntable, thereby strongly heating the center of the bottom surface of an article to be heated and improving the uniformity in heating of the article.

3 Claims, 10 Drawing Figures

TURNTABLE TYPE HIGH-FREQUENCY HEATING APPARATUS

BACKGROUND OF THE INVENTION

This invention relates to a turntable type high-frequency heating apparatus which performs high-frequency heating while rotating a turntable on which an article to be heated is placed.

Field of the Invention

Many proposals have been made to attain uniform heating by microwave ovens. However, only a few proposals have been material into practical applications, and most of them do not timely achieve, objectively, uniform heating of an article. Although conventional microwave ovens can uniformly heat a specific load, they fail to uniformly heat other loads of different shapes and materials.

Various causes of the failure of the uniform heating are considered, and one of them seems to be as follows: Since the heating chamber of a microwave oven is generally substantially a rectangular parallelepiped cavity resonator, the electric field in the chamber can be mathematically solved when no load is contained in the chamber. However, when a dielectric of an arbitrary shape and material is contained in the chamber, the electric field distribution is altered. In general, it is difficult to mathematically solve the electric field when a load is placed in the chamber. When a dielectric of another different shape and material is accomodated in the chamber, a still different electric field distribution is obtained. However, it is not possible to accurately determine the variation in the electric field in the chamber. In the production design of an actual microwave oven, a wide variety of considerations have been made so as to uniformly heat a load of various types by "cut-and try" technique. Since actual loads involve a variety of shapes and materials, no present microwave oven can practically heat satisfactorily uniformly the various loads. The latest microwave oven of the type which is considered to most uniformly heat loads of various shapes and materials is the turntable type. However, this type also has drawbacks and disadvantages. One of the drawbacks of the turntable type microwave oven is that the center of a load is heated weakly. It is generally considered that the microwave oven achieves the heating of a load not only from the periphery of the load but from the interior of the load as compared with other types of heating. Still the microwave oven can heat the periphery of the load more strongly than other parts. There are microwave ovens of the turntable type which can strongly heat the interior rather than the periphery of the load. However, some of them can strongly heat the center of a planar thin load, but can still weakly heat the center of a lumped load, and, on the contrary, others can strongly heat the center of the lumped load, but can still weakly heat the center of the planar load. There are heretofore some proposals of microwave ovens which can strongly heat the center of a load. In this case, even if the electric field at the center of a cavity resonator of the oven in which no load is contained is strong, the oven cannot still heat strongly the center of an arbitary load when the load is contained in its heating chamber. Most of the conventional microwave ovens can be said to weakly heat the center of a lead in view of the actual heating results of loads.

The inventor of the present invention has, therefore, investigated a wide variety of conventional microwave ovens as to the high-frequency electromagnetic field distribution and high-frequency heating, and has studied the basic principles of heating effected by the electromagnetic field in these conventional microwave ovens.

There is a Faraday isolator which is interested in the above-described points of view. FIGS. 1*a* and 1*b* show a longitudinal cross-section of this isolator usefull to understand the operating principles. The isolator propagates a high-frequency wave in one direction (from the left side to the right side in the example of FIGS. 1*a* and 1*b*) almost without attenuation, but propagates the high-frequency wave in the reverse direction (from the right side to the left side in FIGS. 1*a* and 1*b*) with very large attenuation such that it substantially does not propagate the wave.

This Faraday isolator includes three resistance plates $R_1$, $R_2$ and $R_3$ disposed in a circular waveguide I which is excited in a $TE_{1,1}$ mode, two ferrite rods $F_1$ and $F_2$ respectively disposed between the plates $R_1$ and $R_2$, and between the plates $R_2$ and $R_3$, and means (not shown) for applying a DC magnetic field $H_0$ to the rods $F_1$ and $F_2$. The resistance plates $R_1$ and $R_3$ are disposed perpendicularly to the electric field. The resistance plate $R_2$ is disposed and inclined at an angle of 45° clockwise with respect to the plates $R_1$ and $R_3$. As already well known, the direction of the electric field can be rotated clockwise at +45° and −45° when the ferrite and the DC magnetic field are selected to adequate values.

In FIG. 1*a*, the incident high-frequency from the left side is assumed to propagate in a direction as designated by a large arrow $D_1$. The direction of the electric field is shown by a thin arrow E. This wave propagates from the left side to the right side in FIG. 1*a*. Since the resistance plate $R_1$ is disposed, as described above, perpendicularly to the electric field, the plate $R_1$ hardly affects or attenuates the electric field. The direction of the electric field is rotated at 45° clockwise at the position of the ferrite rod $F_1$. Since the resistance plate $R_2$ is inclined at 45° clockwise, the electric field propagates almost without variation because the electric field is disposed perpendicularly to the resistance plate $R_2$. The direction of the electric field is rotated at 45° counterclockwise at the position of the next ferrite rod $F_2$, and is then returned to the original direction. Since the resistance plate $R_3$ is disposed perpendicularly to the electric field, the plate $R_3$ does not substantially alter the electric field. Accordingly, in FIG. 1*a*, the high-frequency electric field which propagates from the left side to the right side is propagated almost without attenuation. In FIG. 1*b*, the reflected electromagnetic wave propagates from the right side to the left side in a direction designated by a large arrow $D_2$. The electric field is not attenuated by the resistance plate $R_3$, but is inclined at 45° counterclockwise by the ferrite rod $F_2$. Then, the electric field becomes parallel to the resistance plate $R_2$, and is largely attenuated while passing the plate $R_2$. The electric field is then rotated at 45° clockwise by the ferrite rod $F_1$, and propagates toward the left end without being affected by the influence of the resistance plate $R_1$. Accordingly, in FIG. 1*b*, the high-frequency wave which thus propagates from the right side to the left side is largely attenuated and is scarcely propagated.

The principle of the Faraday isolator has thus been described. It is noted in the description of the isolator that the high-frequency electric field which is perpendicular to the resistance plate $R_2$ is not attenuated, but the high-frequency electric field which is parallel to the plate is largely attenuated. As viewed from the side of the resistance plate $R_2$, the plate $R_2$ scarcely absorbs the electric field when the plate $R_2$ is disposed perpendicularly to the electric field, but largely absorbs the electric field and hence generates heat when the plate $R_2$ is disposed parallel to the electric field.

The fact is heretofore well known. As shown in FIG. 2, when an elongated tape-shaped paper P is to be heated or dried, the paper P or a load is placed parallel to the electric field. Conversely when the paper P is placed perpendicularly to the electric field, the paper P is hardly heated.

The above-described two examples relate to a waveguide which is excited in the lowest-order mode or in the dominant mode. In such a case even if high-frequency power of 700 W is, for example, applied to the waveguide, a phenomenon occurs in which a load is hardly heated when the load is placed perpendicular to the electric field and, on the other hand, the load can be extremely heated when the load is placed parallel to the electric field. In microwave ovens generally used at the present time the dimensions of the cavity is suitably selected so that high-order modes are produced in the cavity, and further, the electric field is agitated by stirrer blades or the like. For this reason, it is difficult to confirm whether the electric field is parallel to or perpendicularly to the load in a simple relationship. However, it is surely supposed that the electric field is absorbed when the load is placed parallel to the electric field and is hardly absorbed when the load is placed perpendicular to the electric field even in the higher-order modes.

There is disclosed as an example of such phenomena in U.S. Pat. No. 3,975,606. This patent discloses that, when an antenna of a magnetron is provided at the center on the upper surface of a cavity of 311 mm in width, 335 mm in depth and 250 mm in height, a mode having 5 in width, 1 in depth and 0 in height is produced with a frequency of 2,450 MHz. In this case, there is described the fact that an electric field is produced only in the a vertical direction, and when a plate-shaped load is placed in the electric field, five heated stripes are produced at the positions corresponding to the crests (or loops) of the electric field in case where the load is placed vertically (parallel to the electric field), while no heating is effected at the positions corresponding to the valleys of the electric field in case where the load is placed horizontally (perpendicular to the electric field), but the portions corresponding to the valleys (or nodes) of the electric field are weakly heated, and four heated stripes are produced. As to the reason why the portions of valleys of the electric field are heated, it is presumed that an electric field parallel to the load is secondarily produced. In other words, the load can be largely heated when the load is placed parallel to the electric field even in an oven cavity, but the load is scarcely heated when the load is placed perpendicular to the electric field. Accordingly, if an electric field which is always parallel to the load is applied to the load of various types placed in the oven cavity, the load can be heated uniformly with very high efficiency.

SUMMARY OF THE INVENTION

It is an object of the present invention to provide a high-frequency heating apparatus such as a microwave oven of the turntable type which can eliminate the aforementioned drawbacks and disadvantages of the conventional microwave ovens of the turntable type in that the heating of the center of a load is weak and hence the load is not heated uniformly.

In order to achieve the above object, there is provided a high-frequency heating apparatus which comprises a turntable provided on the bottom wall of a heating chamber, and a rectangular waveguide which is disposed under the turntable and is excited in a $TE_{o,n}$ mode, the terminating opening of the waveguide being disposed vertically, thereby always producing a horizontal electric field on the food-receiving turntable and uniformly heating the food on the turntable.

Embodiments of the invention will now be described in detail with reference to the attached drawings, in which:

FIGS. 1*a* and 1*b* are longitudinal cross-sectional views of a Faraday isolator for explaining the presence or absence of the absorption of the electric field to generate heat in a load depending upon the angle between the load and the electric field;

DESCRIPTION OF PREFERRED ENBODIMENTS

The embodiments of the present invention will now be described in more detail with reference to the accompanying drawings.

Figure 1A:
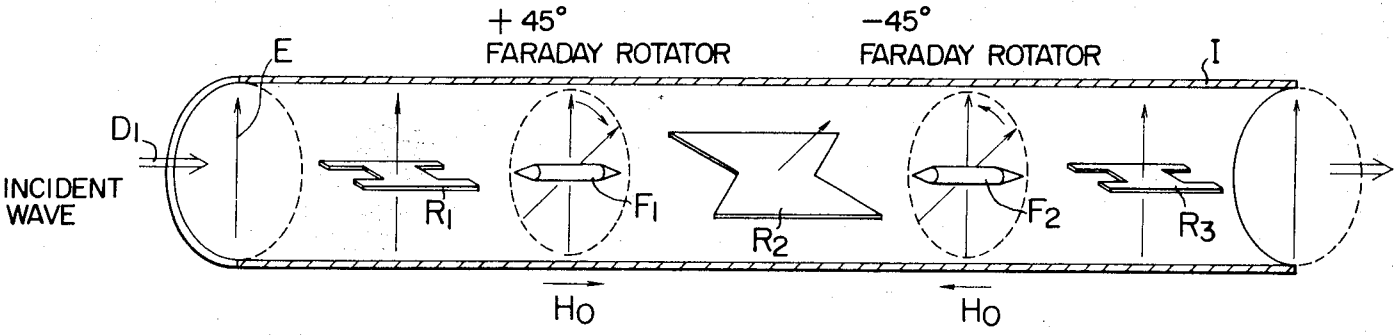
FIG. 1a (PRIOR ART)
Figure 1B:
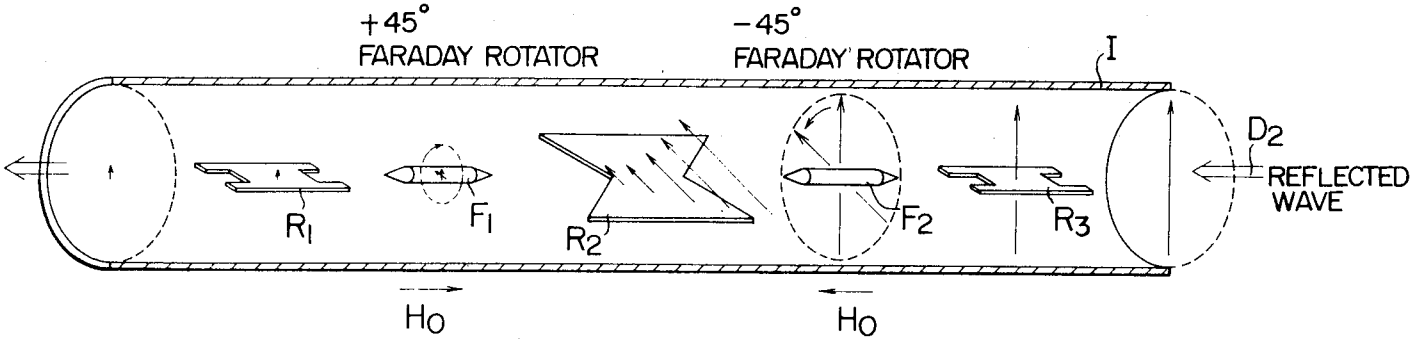
FIG. 1b (PRIOR ART)
Figure 2:
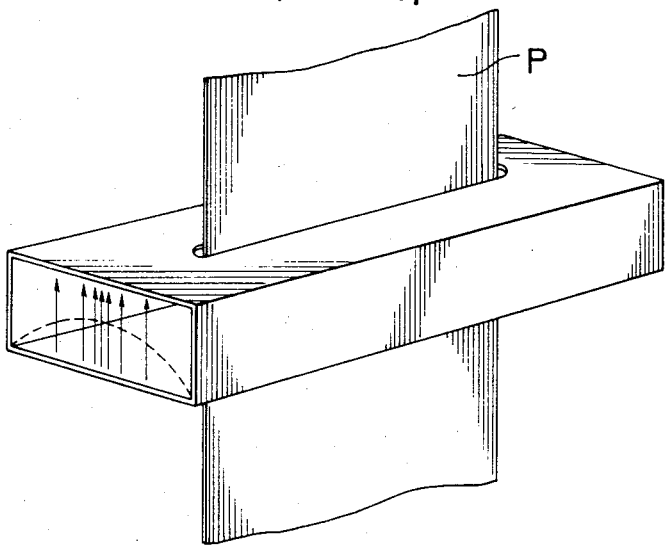
FIG. 2 (PRIOR ART)
FIG. 2 is a perspective view showing a principal part of a paper drying device as a conventional example in which a load (paper) is placed parallel to an electric field.
Figure 3:
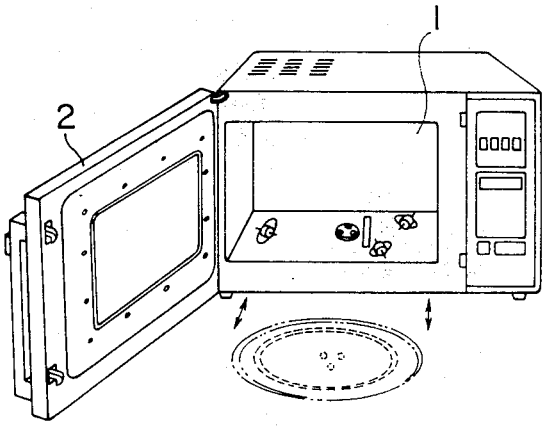
FIG. 3 is a perspective view showing the external appearance of a microwave oven in an opened door state as an embodiment according to the present invention.

FIG. 3 shows a perspective view of the external appearance of a microwave oven with a door opened, as an embodiment according to the present invention. A heating chamber 1 is formed of a thin stainless steel plate and substantially in a rectangular parallelepiped shape, and has an openable door 2 provided at the front opening.

Figure 4:
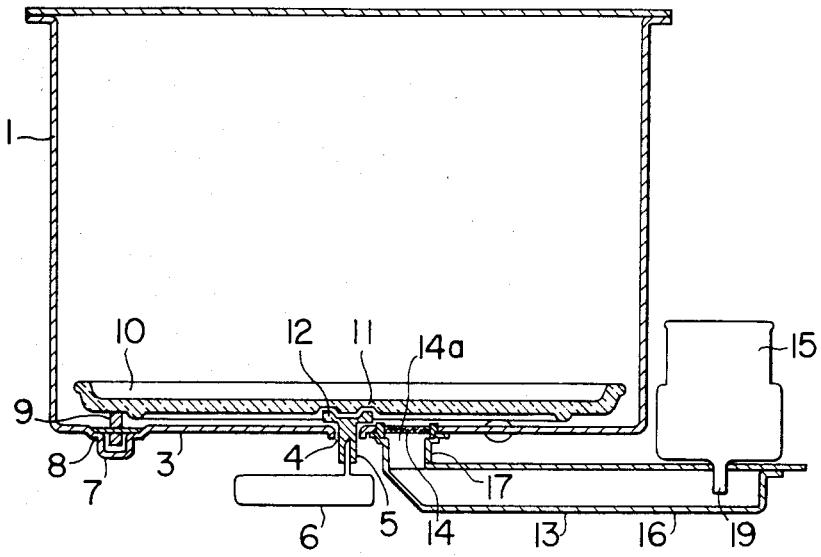
FIG. 4 is a sectional view showing a principal part of the oven in FIG. 3.

In FIG. 4, a through hole 4 is formed at the center of a bottom wall 3 of the heating chamber 1, and a drive shaft 5 made of silicon resin is provided through the hole 4. The drive shaft 5 is coupled to a drive motor 6 which is provided under the drive shaft 5, and is rotatably secured to the motor 6. Three recesses 7 are formed in the bottom wall 3 of the heating chamber 1, and rollers 9 made of tetrafluoroethylene, through which shafts 8 of stainless steel are passed are respectively received in the recesses 7. A circular turnable 10 made of crystallized glass is placed on the three rollers 9. Another recess 11 is formed at the center on the lower surface of the turntable 10, and is engaged with a projection 12 of the drive shaft 5. A waveguide 13 is provided in the vicinity of the hole 4 of the bottom wall 3 of the chamber 1, and a terminating end opening 14*a* at one end of the waveguide 13 is blocked with an opening cover 14 made of crystallized glass, and is secured with silicon rubber at the periphery of the cover. The waveguide 13 is coupled with the heating chamber 1 at the terminating opening 14*a*. A magnetron 15 is mounted at the vicinity of the other end of the waveguide 13, and an antenna 19 is projected into the waveguide 13.

Figure 5:
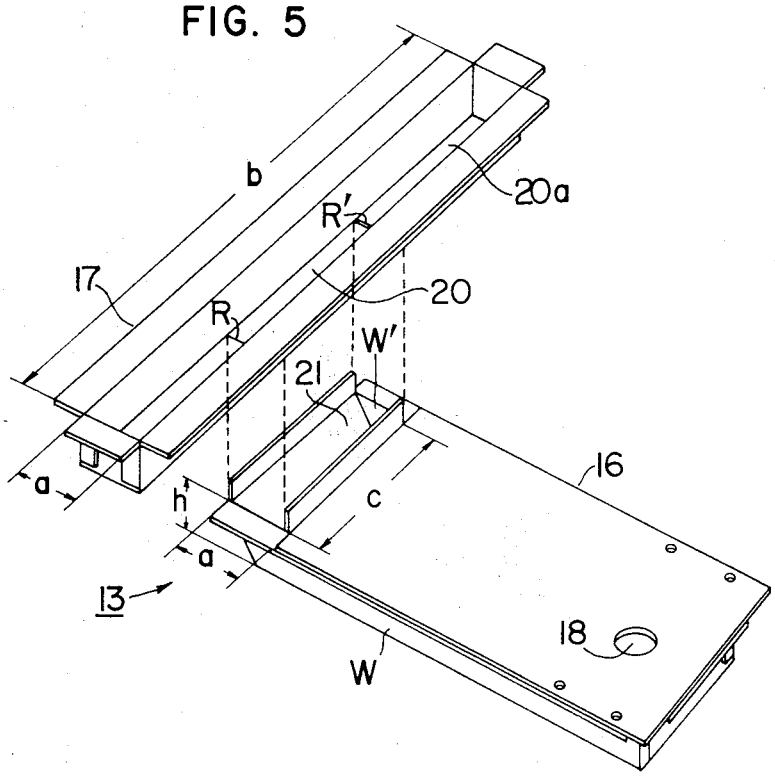
FIG. 5 is a perspective exploded view of a waveguide used in the oven in FIG. 4.

In FIG. 5, which shows a perspective exploded view of the waveguide 13, the waveguide 13 which is formed by welding thin aluminized steel plates is composed of a horizontal block 16 and a vertical block 17. The horizontal block 16 is formed into a rectangular shape by bending and welding two plates, and has for example, a width C=9.5 cm and a height h=3 cm. A circular hole 18 is formed in the vicinity of one end of the horizontal block 16, and the antenna 19 of the magnetron 15 is vertically inserted into the hole 18. The vertical block 17 is formed into a rectangular shape by bending and welding one plate, and has a rectangular cross section, a width a=3 cm and a length b=28.5 cm. Further, the vertical block 17 has a bottom wall 20*a* partially blocking an opening 20 opposite to the terminating opening 14*a*, and the bottom wall 20*a* is divided equally into three segments along the length thereof, each segment having a length of 9.5 cm. The opening 20 is formed at the central segment and is aligned with an opening 21 of the horizontal block 16, and both blocks are secured fixedly by welding with each other. In this manner, a bent waveguide 13 of type shown in FIG. 4 is formed. As described in the foregoing, the horizontal block 16 has a rectangular cross section, h×c or a×c (h=a), and the vertical block 17 has a rectangular cross section, a×b or a×n·c. Thus, the vertical block 17 has the width (i.e., the length b of the cross section) n times larger than the width c of the horizontal block 16, and the axis of the vertical block 17 is perpendicular to the bottom wall 3 of the heating chamber. The n may be any positive integer and in this embodiment shown in FIG. 5, n=3, since b=28.5 cm and c=9.5 cm.

Figure 6:
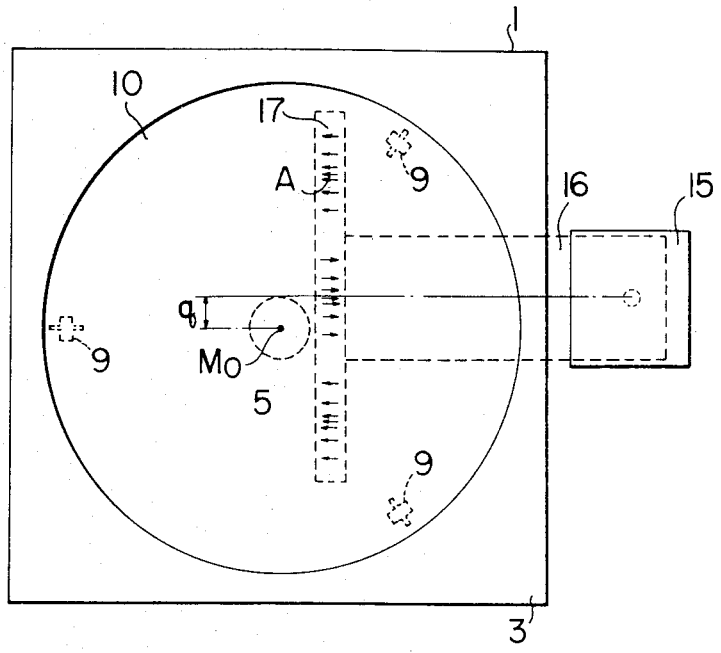
FIG. 6 is a schematic plan view of the bottom wall surface of a heating chamber of the oven in FIG. 4.

FIG. 6 shows a schematic plan view of the bottom wall 3 of the heating chamber 1, in which the center line of the waveguide 13 shown by a dotted chain line is displaced by a distance q of $\frac{1}{4}$ (2.375 cm) of the width of 9.5 cm of the horizontal block 16 (or the length of the segment of the vertical block 17) from the rotating center $M_0$ of the drive shaft 5.

The operation of the embodiment of the microwave oven will now be described. Since the size of the sectional area of the horizontal block 16 of the waveguide 13 is 9.5 cm×3 cm, and since the antenna 19 of the magnetron 15 oscillating at 2,450 MHz is coupled with the horizontal block 16 in parallel with the side wall W of a height, 3 cm thereof, the horizontal block 16 is, as well known, excited in the $TE_{0,1}$ mode. Since the size of the sectional area of the vertical block 17 is 28.5 cm×3 cm and the opening 20 at the center segment of the bottom wall is coupled with the opening 21 of the horizontal block 16 which has the width of $\frac{1}{3}$ of the length of the vertical block 17 and which is excited in the $TE_{0,1}$ mode, the vertical block 17 is excited in a $TE_{0,3}$ mode. As a result, an electric field showin by arrows A in FIG. 6 is induced in the vertical block 17.

Since the cutoff wavelength $\lambda_0$ of the rectangular waveguide having a sectional area of a cm in width and b cm in length is generally represented by the following equation and the wavelength of the oscillation frequency 2,450 MHz is 12.24 cm, this is substituted in the equation.

$$\lambda_0 = \frac{2}{\sqrt{(m/a)^2 + (n/b)^2}} \tag{1}$$

where m and n are zero or the positive integers. Then, $$\left(\frac{m}{a}\right)^2 + \left(\frac{n}{b}\right)^2 < \left(\frac{1}{6.12}\right)^2 \tag{2}$$

This formula is the condition of transmitting the 2,450 MHz. When a=3 and b=28.5 are substituted in the formula (2), m=0, n=1, 2, 3 and 4 satisfy the condition. In other words, the vertical block 16 of this embodiment can propagate in four modes of $TE_{0,1}$, $TE_{0,2}$, $TE_{0,3}$ and $TE_{0,4}$. However, since the vertical block 17 is coupled with the horizontal block 16 in such that the center line of the vertical block 17 which is located at $\frac{1}{2}$ of the length b of the bottom wall is aligned to the center line of the width c of the horizontal block 16 having the maximum electric field strength located at the center line of the width c, the vertical block 17 can not be excited in the $TE_{0,2}$ and $TE_{0,4}$ modes in which the electric field on the center line is zero. Further, the positions of points R and R′ which divide the length of 28.5 cm of the vertical block 17 into three equal distances correspond respectively to side walls W and W′ of the horizontal block 16, and since the electric fields at the positions R and R′ are zero, the vertical block 17 of the waveguide 13 is considered to be excited in the $TE_{0,3}$ mode. To confirm this fact, a load which varies in color with heat such as a filter paper which has been immersed in aqueous cobalt chloride solution is disposed at the position which blocks the vertical block 17 of the waveguide 13. The filter paper is heated and the color of these portions corresponding to the arrows in FIG. 6 are varied.

Figure 7:
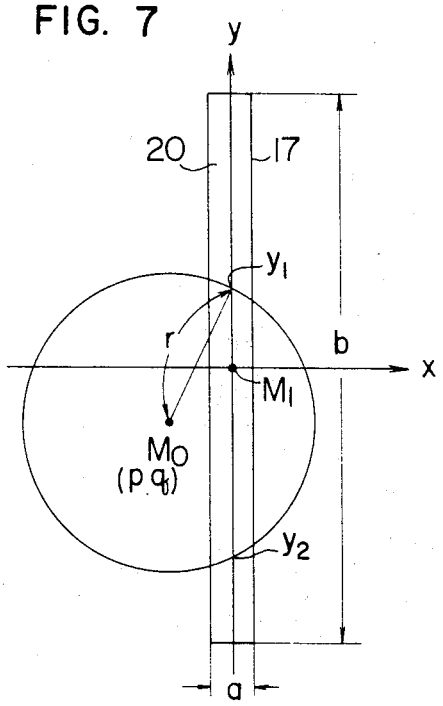
FIG. 7 is plan coordinates showing the position relationship between the opening of a waveguide and the rotating center of a turntable in the oven to calculate the heating strengths at various points.

FIG. 7 shows plan coordinates having as an origin $M_1$ the center of the opening 20 of the vertical block 17 of the waveguide 13. The coordinates have a y-axis along the direction of the length b of 28.5 cm and an x-axis along the direction of the width a of 3 cm, and a position (p, q) of the rotating center $M_0$ of the drive shaft 5. A circle having a radius r is drawn around the center $M_0$. Assuming that the vertical block 17 of the waveguide 13 is excited in the $TE_{0,n}$ mode, the electric field intensity E on the y-axis is represented by the following equation:

$$E = E_0 \cos \frac{2n\pi}{b} y \tag{3}$$

where $E_0$ is the electric field intensity on the x-axis, and b is the length of the waveguide 13 (vertical block 17) in the y-axis direction (b=28.5 cm). The radius r is represented by the following equation:

$$r = \sqrt{p^2 + (y - q)^2} \quad (4)$$

When this equation is substituted in the equation (3), the following equation can be obtained:

$$E = E_0 \cos \frac{2n\pi}{b} \left( \sqrt{r^2 - p^2} + q \right) \quad (5)$$

Since the circle of the radius r has two cross points $y_1$ and $y_2$ with the y-axis, there is the following relationship between both the cross points $y_1$ and $y_2$:

$$y_1 = 2q - y_2 \quad (6)$$

Assume now that the width a is sufficiently small and that the electric power received by the respective points on the circumference of the radius r explosed to the opening of the vertical block 17 while the turntable 10 turns one revolution is represented by H, the electric power H is proportional to the square of the electric field and the heating is effected at two cross points $y_1$ and $y_2$. Thus, the following formula can be obtained:

$$H \propto \frac{1}{2\pi r} \left\{ \cos^2 \frac{2n\pi}{b} \left( \sqrt{r^2 - p^2} + q \right) + \cos^2 \frac{2n\pi}{b} \left( q - \sqrt{r^2 - p^2} \right) \right\} \quad (7)$$

When this is simplified, the following formula can be obtained:

$$H \propto \frac{1}{2\pi r} \left\{ 1 + \cos \frac{4n\pi}{b} q \cdot \cos \frac{4n\pi}{b} \sqrt{r^2 - p^2} \right\} \quad (8)$$

Accordingly, if the q is represented by, $$q = \pm \frac{b}{4n} \quad (9)$$

the following formula can be obtained:

$$H \propto \frac{1}{2\pi r} \quad (10)$$

It will be understood from the foregoing equations and the formula that, the smaller the radius r is, the stronger the center on the turntable 10 can be heated, and when the radius r is increased, the periphery can be heated inversely proportional to the radius r. In this manner, the center can be desirably heated stronger by making the radus r smaller.

As described above, even if the strong electric field can be obtained in calculation theoretically in the cavity resonator at no load condition, the electric field at the position where a load is contained in the resonator is not always strong. On the other hand, the distribution of the electric field within the waveguide 13 can be attained as calculated at least to the position at which the opening 20 is located. This will be clear from the above-mentioned example of the filter paper.

In this manner, the heating intensity distribution can be calculated when the load is placed immediately above the opening 20 of the waveguide 13 having the electric field distribution as calculated. The longer the distance from the opening 20 to the load becomes, the more deviates the heating intensity from the calculated results. The higher the high-frequency losses in the opening cover 14 and the turntable 10 are, it is evident that the heating intensity deviates more from the calculated results.

In the embodiment described above, the portion above the drive shaft 5 is not heated at all, but it is a matter of design to reduce the adverse effect of the shaft 5 in consideration of the requirements for the actual cooking in the microwave oven. The above embodiment employs the $TE_{0,3}$ mode. However, similar results can also be obtained in the $TE_{0,n}$ mode (n represents positive integers).

Figure 8:
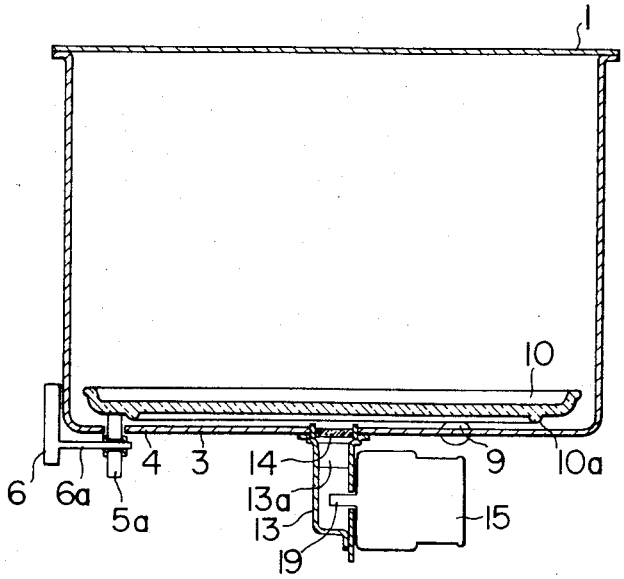
FIG. 8 is a sectional view showing a principal part of a microwave oven as another embodiment according to the present invention.
Figure 9:
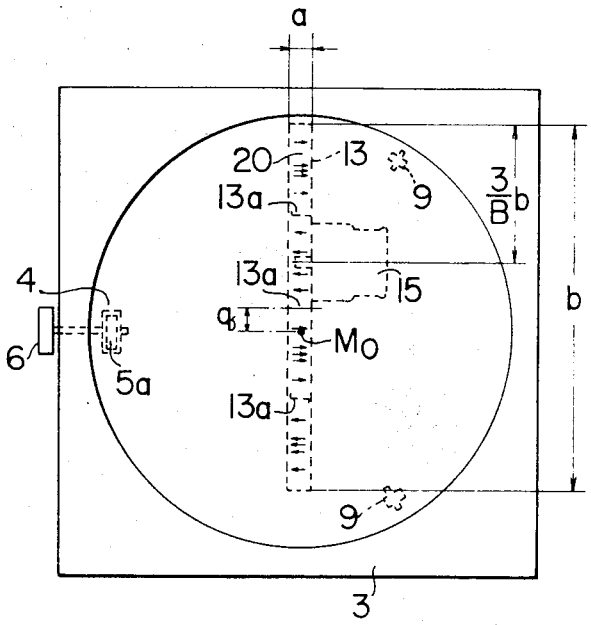
FIG. 9 is a schematic plan view of the bottom wall surface of the heating chamber of the oven in FIG. 8.

FIG. 8 shows another embodiment of the invention, and FIG. 9 is a plan view of the bottom surface of the heating chamber of the oven in FIG. 8. Only the different points from the embodiment in FIG. 4 will be described. A drive motor 6 is provided at the left side of a heating chamber 1. A drive roller 5*a* secured to the shaft 6*a* is made of silicon rubber in a disc shape, and is passed through a hole 4 of a rectangular shape formed in the bottom wall 3 of the heating chamber 1. The periphery of the drive roller 5*a* is projected into the heating chamber 1 through the hole 4, and the circumferential surface of the drive roller 5*a* is engaged with the bottom surface of a turntable 10. The turntable 10 is placed on the drive roller 5*a* and two other rollers 9. In FIG. 8, a waveguide 13 has a cross section of a width, a=3 cm and a length, b=38 cm, and extends vertically maintaining the same cross section. In other words, this waveguide 13 is not narrowed nor bent perpendicularly as is the case shown in FIG. 4. An antenna 19 of a magnetron 15 is fixed to project horizontally into the waveguide 13 at the position of 3/8 b from one end of the length b (or 14.25 cm when b=38 cm) of the waveguide 13. The rotating center $M_0$ of the turntable 10 is located at the center of the width a (or on the lengthwise center line) of the waveguide 13, and is displaced when by b/16 (=q) (q=2.375 cm when b=38 cm) from the center of the length b of the waveguide 13. Short-circuiting plates 13*a* are welded (in FIG. 8) parallel to a direction of the width a at the three positions which dividing the waveguide into four equal segments along the direction of the length b.

In the embodiment exemplified in FIGS. 8 and 9, one of the three rollers 9 for supporting the turntable 10 is used as a drive roller 5*a*, and the waveguide 13 is disposed at the center of the turntable 10. Although in the FIG. 4, the drive shaft 5 rotatably drives the turntable 10 and has a role to determine the central position of the rotation and three rollers 9 merely support the turntable 10 to be slidably movable in FIG. 8, the two rollers 9 and the one drive roller 5*a* achieves the function of driving and determining the central position of the rotation. Accordingly, it is necessary to provide a ring-shaped rib 10*a* on the bottom surface of the turntable 10.

In this manner, the waveguide 13 can be disposed under the center of the turntable 10. In other words, the coordinates (p, q) of the rotating center $M_0$ with respect to the central point $M_1$ of the terminating end or the opening a×b of the waveguide 13 correspond to the case in FIG. 7 in which p=0, and thus the center of an article to be heated can be heated strongly.

In the embodiment described with respect to FIGS. 8 and 9, the size of the opening 20 of the waveguide 13 has a width a=3 cm and a length b=38 cm, and the propagation in the modes of n=1, 2, . . . , 6 can be performed from the equation (2). Since the antenna 19 of the magnetron 15 is disposed at the position of $\frac{3}{8}$ from the end, the waveguide 13 can be excited in the $TE_{0,4}$ mode. Three short-circuiting plates 13*a* of an aluminized steel plate are provided at three positions which divide the opening 20 of the waveguide 13 into four equidistant segments along the length b and these three positions coincide with the modes in the $TE_{0,4}$ mode. These short-circuiting plates 13*a* excitement of the waveguide in the $TE_{0,4}$ mode. Since the short-circuiting plates 13*a* are located at the nodes where the electric field intensity parallel to the positions of the short-circuiting plates is zero in the $TE_{0,1}$ mode, the short-circuiting plates 13*a* do not substantially affect the propagation of the electromagnetic wave. However, the short-circuiting plates 13*a* attenuate other modes such as $TE_{0,5}$, $TE_{0,6}$ or $TE_{0,3}$ mode, by causing current to flow through the short-circuiting plates when these modes occur, since the electric field components parallel to the short-circuiting plates are not zero. Accordingly, only the electric field in the $TE_{0,4}$ mode which is not affected is propagated without attenuation. Even in this case, the formula (8) and the equation (9) are applicable.

In summary, (1) It is necessary to apply an electric field parallel to an article to be heated where the article is of a plate shape so as to heat the article (to absorb the electromagnetic wave energy), and the article is scarcely heated in the electric field perpendicular to the article to be heated.

(2) In the conventional microwave ovens of the type in which an article to be heated is placed in a cavity resonator, an electromagnetic field in the cavity resonant varies with the shape and the material of the article to be heated and further it cannot be calculated. Accordingly, it has not been solved at all whether the electric field parallel to the article to be heated is applied to the article or not, and hence the oven has been designed in a cut-and-try manner, and has not achieved uniform heating of the article to be heated.

(3) An electric field which is substantially similar to that within the waveguide 13 can be obtained in the vicinity of the terminating opening 20 of the waveguide 13.

(4) The terminating opening 20 of the waveguide 13 which is excited in a $TE_{0,n}$ mode is positioned immediately under the turntable 10, thereby obtaining an electric field parallel to the turntable 10. Accordingly, when the planar article to be heated is placed horizontally on the turntable 10, an electric field parallel to the article to be heated can be effectively obtained.

(5) As described in the above paragraph (3), since the electric field similar to that within the waveguide 13 can be obtained on the turntable 10, the degree of heating on the turntable 10 can be calculated.

(6) From the calculated results, when the rotating center of the turntable 10 is placed on the line displaced by a distance b/4n from the center of the terminating opening 20 of the waveguide 13, the article can be heated inversely proportional to the distance from the rotating center.

Although it is described that the rotating center is located on the line displaced by a distance b/4n from the center of the waveguide 13 in the above paragraph (6), the center of the waveguide 13 which is excited in the $TE_{0,n}$ mode becomes a crest (a loop) of the standing wave when n is odd, and becomes a valley (a node) when n is even. Since the distance between the adjacent crests (loops) and the valleys (nodes) is b/2n, it is considered in other words that the rotating center $M_0$ is located on the bisector between the crests (loops) and the valleys (nodes) of the standing wave in the waveguide 13.

Then, when a load is not planar such as, for example, a potato, milk in a bottle or in a deep cup, the load has inevitably some horizontal portion at the bottom of the load since the load can be placed on the turntable 10, the horizontal portion is strongly heated, thereby eliminating the drawback of the conventional ovens in that the bottom of the load can hardly be heated. In this case, since the electromagnetic wave which does not contribute to the direct heating of the load is transmitted through the turntable 10 and is emitted into the heating chamber 1 to operate in a similar action as in the conventional microwave ovens of the cavity resonator type, it is necessary to design the microwave oven of the invention in dimensions so that the heating chamber 1 can suitably operable as the cavity resonator.

However, the advantage of the invention is insured in that irrespective of the size and material of a load to be heated, a portion of the load which is in contact with the turntable 10, including the center portion of the contacted portion of the load can be effectively strongly heated. This can eliminate one of the serious disadvantages of the conventional microwave ovens of the turntable type.

According to the present invention as described above, a high-frequency heating apparatus such as a microwave oven can achieve the uniform heating of an article to be heated which has been the problem in the art, and particularly can adequately heat the center bottom portion of the article which has hardly been heated in the conventional ovens. Thus the present invention achieves a significant improvement in the performance of the microwave oven. The heating apparatus according to the invention can meet the requirement for an improved uniform heating of an article which is further required as the automation of the microwave oven is recently advanced with the use of a temperature sensor, a gas sensor or an infrared sensor.

What is claimed is:

1. A high-frequency heating apparatus comprising:

a heating chamber for accommodating an article to be heated;

a door provided at an opening at the front of said heating chamber;

a rectangular waveguide having a terminating opening coupled with said heating chamber at a bottom wall thereof, said rectangular waveguide extending vertically from said terminating opening downwardly;

said rectangular waveguide being excited in a $TE_{o,n}$ mode, where n is any positive integer;

a high-frequency oscillator coupled to said waveguide;

a turntable of a dielectric material disposed in said heating chamber above and in the vicinity of the terminating opening of said rectangular waveguide, so that an electric field substantially similar to said $TE_{o,n}$ mode in said rectangular waveguide and parallel to said turntable is produced on said turntable; and means for rotating said turntable;

the rotating center of said turntable being disposed substantially on a bisector between a loop and a node adjacent to the loop of a standing wave produced in said rectangular waveguide.

2. A high-frequency heating apparatus according to claim 1, wherein said rectangular waveguide comprises a horizontal portion and a vertical portion, and said high-frequency oscillator is provided on said horizontal portion, the horizontal portion of said rectangular waveguide being excited in a $TE_{o,1}$ mode, said vertical portion having a size n times said horizontal portion, and said horizontal portion being coupled to a segment of said vertical portion where said vertical portion is divided equally into n segments.

3. A high-frequency heating apparatus according to claim 1, wherein a short plate is provided parallel to the electric field at the position of a node of said rectangular waveguide to thereby ensure the excitation of said rectangular waveguide in said $TE_{o,n}$ mode.

* * * * *